US006551454B1

(12) United States Patent
Ewens et al.

(10) Patent No.: US 6,551,454 B1
(45) Date of Patent: Apr. 22, 2003

(54) METHOD FOR PRODUCING COATED CALENDERED PAPER

(75) Inventors: Steven Simpson Ewens, Grand Rapids, MN (US); Timothy Joseph Dumm, Grand Rapids, MN (US); Stephen Robert Holmes, Grand Rapids, MN (US)

(73) Assignee: Blandin Paper Company, Grand Rapids, MN (US)

( * ) Notice: Subject to any disclaimer, the term of this patent is extended or adjusted under 35 U.S.C. 154(b) by 0 days.

(21) Appl. No.: 09/763,951

(22) PCT Filed: Nov. 30, 1999

(86) PCT No.: PCT/US99/28188

§ 371 (c)(1),
(2), (4) Date: May 7, 2001

(87) PCT Pub. No.: WO00/32870

PCT Pub. Date: Jun. 8, 2000

(51) Int. Cl.[7] ..... D21G 1/00; D21H 25/04

(52) U.S. Cl. ..... 162/119; 162/206; 162/207; 427/361; 427/366; 34/446

(58) Field of Search ..... 162/119, 134, 162/135, 136, 197, 201, 204, 205, 206, 207, 265, 270, 283, 198, 199, 263, 272, DIG. 6, DIG. 10; 34/444, 445, 446; 100/38, 74; 427/324–326, 336, 361, 365, 366

(56) References Cited

U.S. PATENT DOCUMENTS 5,213,873 A * 5/1993 Yasuda et al. ..... 428/195
5,425,851 A * 6/1995 Cason et al. ..... 162/206

* cited by examiner

*Primary Examiner*—Steven P. Griffin
*Assistant Examiner*—Eric Hug
(74) *Attorney, Agent, or Firm*—Birch, Stewart, Kolasch & Birch, LLP

(57) ABSTRACT

Several paper grades are finished in a supercalender (1) or similar calender types in order to increase the smoothness, gloss and other properties of the paper. According to the invention, the method for producing coated and calendered paper or paper board, comprises steps of coating a sheet of paper or paper board and bringing the sheet containing water to a calender (1), leading the sheet in at least one nip formed by two rolls (18, 19) of the calender (1) and imposing simultaneously heat and pressure on the sheet in the nip in order to treat the surface of the web, whereby also water is removed from the sheet, removing water from the sheet before winding in such an extent that the moisture content of the sheet is adjusted to a value of 4.0% or less, leading the treated sheet to a winder (21), and winding the sheet on a roll.

22 Claims, 11 Drawing Sheets

METHOD FOR PRODUCING COATED CALENDERED PAPER

This application is the national phase under 35 U.S.C. §371 of PCT International Application No. PCT/US99/28188 which has an International filing date of Nov. 30, 1999, which designated the United States of America and which claims priority to U.S. Ser. No. 09/201590 filed Nov. 30, 1999, now abandoned.

The present invention relates to the production and manufacture of coated paper grades that are finished especially in a supercalender in order to increase the smoothness, gloss and other properties of the paper. The biggest benefits are obtained with a base web that includes at least some mechanical fiber. The improved properties of the printing surface improve the final quality of the printed sheet. The printability of paper and the quality of the printed surface are primary quality factors that are valued by the users of paper. Different kinds of calendering methods like soft-nip, opti-load and Janus Concept Calenders are used both on uncoated and coated paper grades as well as paper board grades.

BACKGROUND OF THE INVENTION

The finest quality of the paper surface has been achieved by treating a base paper sheet by a supercalender. A supercalender comprises a plurality of soft and hard rolls that are arranged on a vertical stack so that each soft roll is between two hard rolls and vice versa. The stack of rolls can be pressed together in order to produce high linear forces between the contacting surfaces of the rolls. The linear forces are often called nip forces. The hard rolls can be heated. The smoothing of the paper surface is achieved by simultaneously subjecting the fiber structure to high pressure and heat. Under the influence of these forces the fibers forming the paper reach their glass transit temperature and the deformation caused by the nip load is permanent. Sliding of the paper surface on the surface of the rolls also causes deformation of the fibers and increases the smoothing effect. Modern multi-nip calenders comprise often soft rolls made of polymer compounds and effective means for controlling independently the nip loads between each nip of hard and soft roll. These modern types of calenders have several benefits over the earlier supercalenders, the main advantages being better controllabilty and runnability.

One important factor that affects the physical behavior of the paper in the calender nip is the moisture of the base sheet entering the calender. When the moisture content of the paper increases, the effect of the heat and pressure on the fibers is enhanced and the smoothing and glossing effect is increased. The caliper (thickness) of the paper diminishes also during calendering and on the wetter parts of the sheet the reduction of caliper is greater. Therefore, the moisture content of the sheet should be even in cross- and machine directions in order to prevent variations of caliper, gloss, smoothness and other properties of the sheet. For this reason paper is dried usually to high dryness before calendering and it is rewetted for example by steam to a desired moisture level. Steam can be also used for leveling the differences of the moisture content if information on actual moisture content of the sheet is available.

The control of moisture during manufacture differs on manufacturing coated and uncoated paper grades. During coating the base web, which has already been dried to a desired moisture content during manufacture, is wetted and dried at least twice. The coating mix is a admixture of water and additives. When the mix is spread on the base web, the web adsorbs some of the water and the water has to be removed from the web by drying. Coating of both sides of the base web requires two coating and drying cycles and if multiple coating layers are desired, the number of cycles increases accordingly. Several wetting and drying cycles inherently mean that the moisture profile of the web is normally more even than the moisture profile of an uncoated sheet that is dried only once. Water absorbed into a coated web exits the web more slowly through the coating layer, whereby the fibers absorb more water which causes more fiber rise in paper of board grades that contain mechanical fiber.

Modern calenders like soft-nip, opti-load and Janus Concept calenders are usually considered modern supercalenders since these also employ multiple calendering nips. These evolution supercalenders feature more sophisticated possibilities to control the nip loads, roll temperature and sheet moisture than traditional supercalenders. The basic operation principle of using high linear load and heat for smoothing the paper is the same as on supercalenders.

In other types of calenders the nip loads and amount of heat used are smaller than in supercalenders. Therefore, the quality obtained by these methods is not as good as that which is obtainable with supercalenders, but the same physical phenomena occur in all kinds of calenders and the effect on the fibers is the same. It must be noted that sliding of the paper on the nip may, in some calender types, have a more significant role than in a supercalender. Especially so called shoe- or long-nip calenders, wherein the sheet is pressed on a roll with a special pressing shoe over a long distance, offer different operational possibilities than calenders in which the processing time in each nip is shorter. However, the actual basic method of using the combination of heat and pressure for finishing the paper surface is always the same.

SUMMARY OF THE INVENTION

It is an object of the present invention to provide an improved method of producing coated and calendered paper and paper board.

It is another object of the invention to provide a novel apparatus for producing calendered paper or paper board.

The invention is most suitable for products wherein the base web of the product contains mechanical fiber, for example groundwood fiber.

According to the present invention the calendered sheet is dried into a moisture content that is 4.0% or less, preferably 3.5% or less, in particular 3.2 to 0.1%, calculated from the dry weight of the paper or paper board.

According to one preferred embodiment of the invention the sheet is dried into a moisture content that is 3.5% or less and remoisturized to a moisture content of 4.0% or less.

According to the other aspects of the present invention, the moisture content of the sheet entering the calender from a paper making machine, coater or an unwinder is at least about 3.0%, preferably 3.0 to 8.0%.

The invention is preferably implemented on supercalendered and coated paper grades. The invention may also be implemented on other calendering methods like soft-nip, opti-load and Janus Concept Calenders and for paper board.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

DETAILED DESCRIPTION OF THE PRESENTLY PREFERRED EMBODIMENTS

Figure 1:
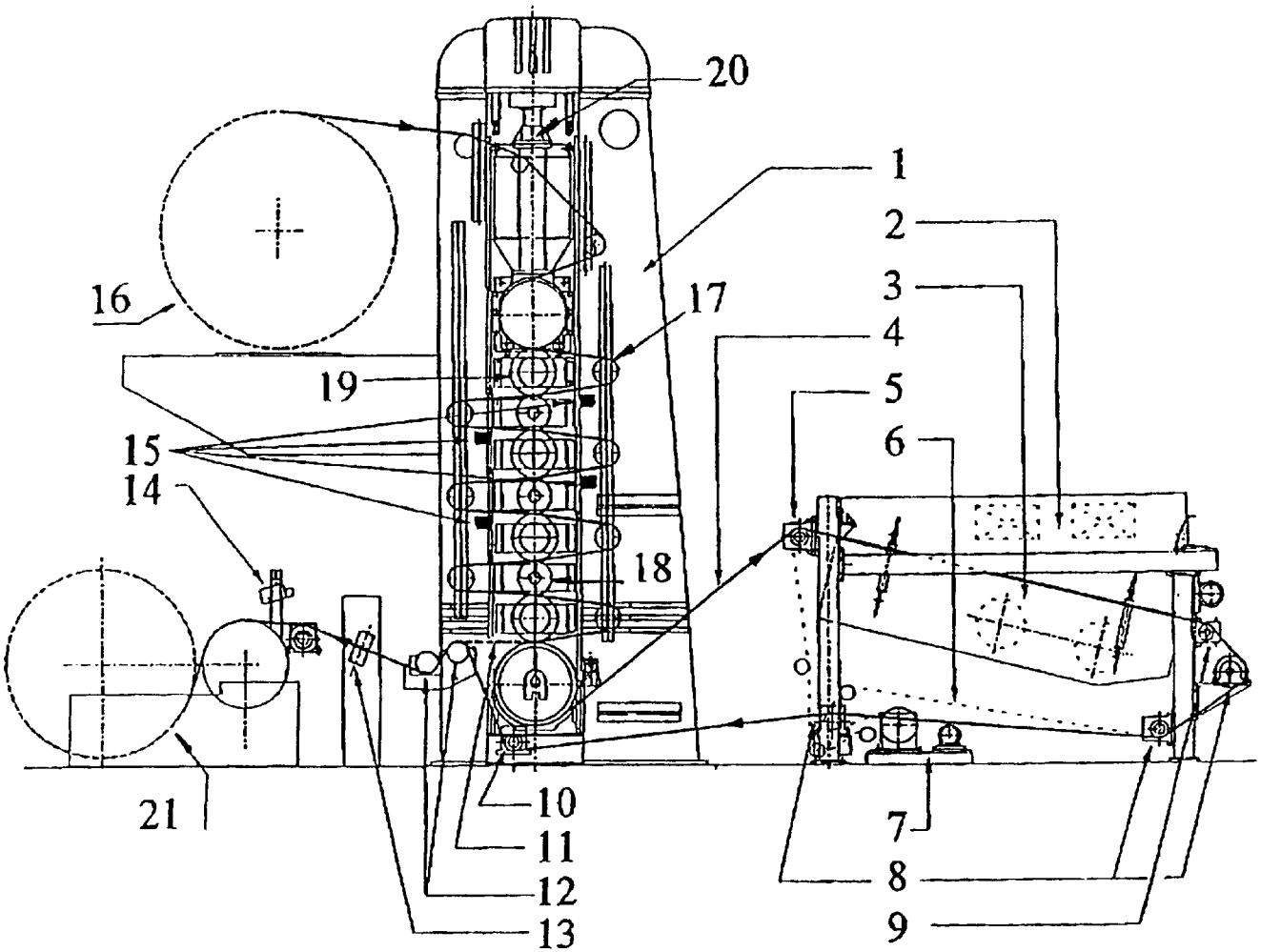
FIG. 1 is a schematical side view of a supercalender according to the invention.
Figure 2:
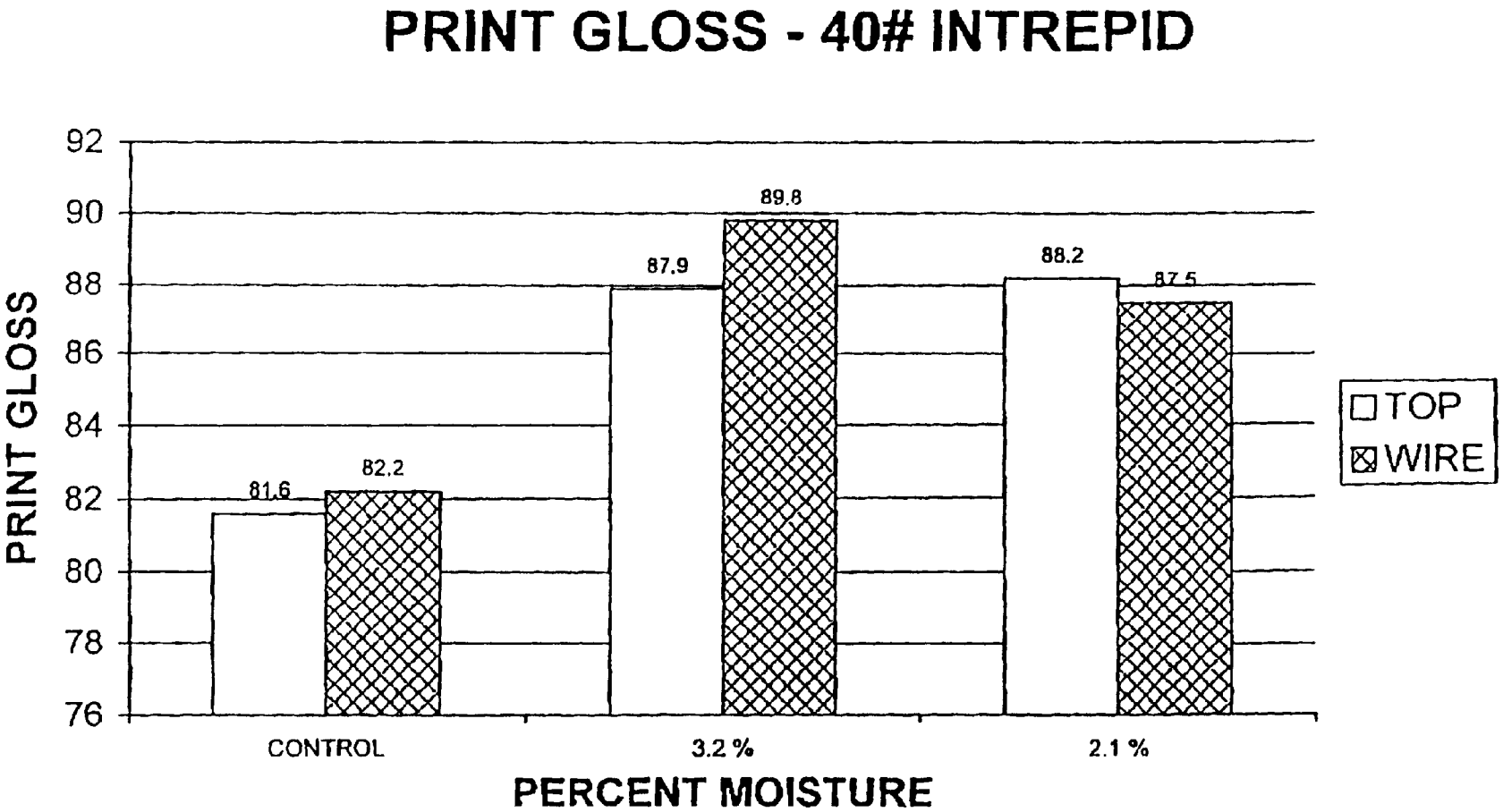
FIGS. 2 to 5 are diagrams showing the effect of the end moisture of the calendered sheet on gloss of printed sheet for some paper grades.
Figure 3:
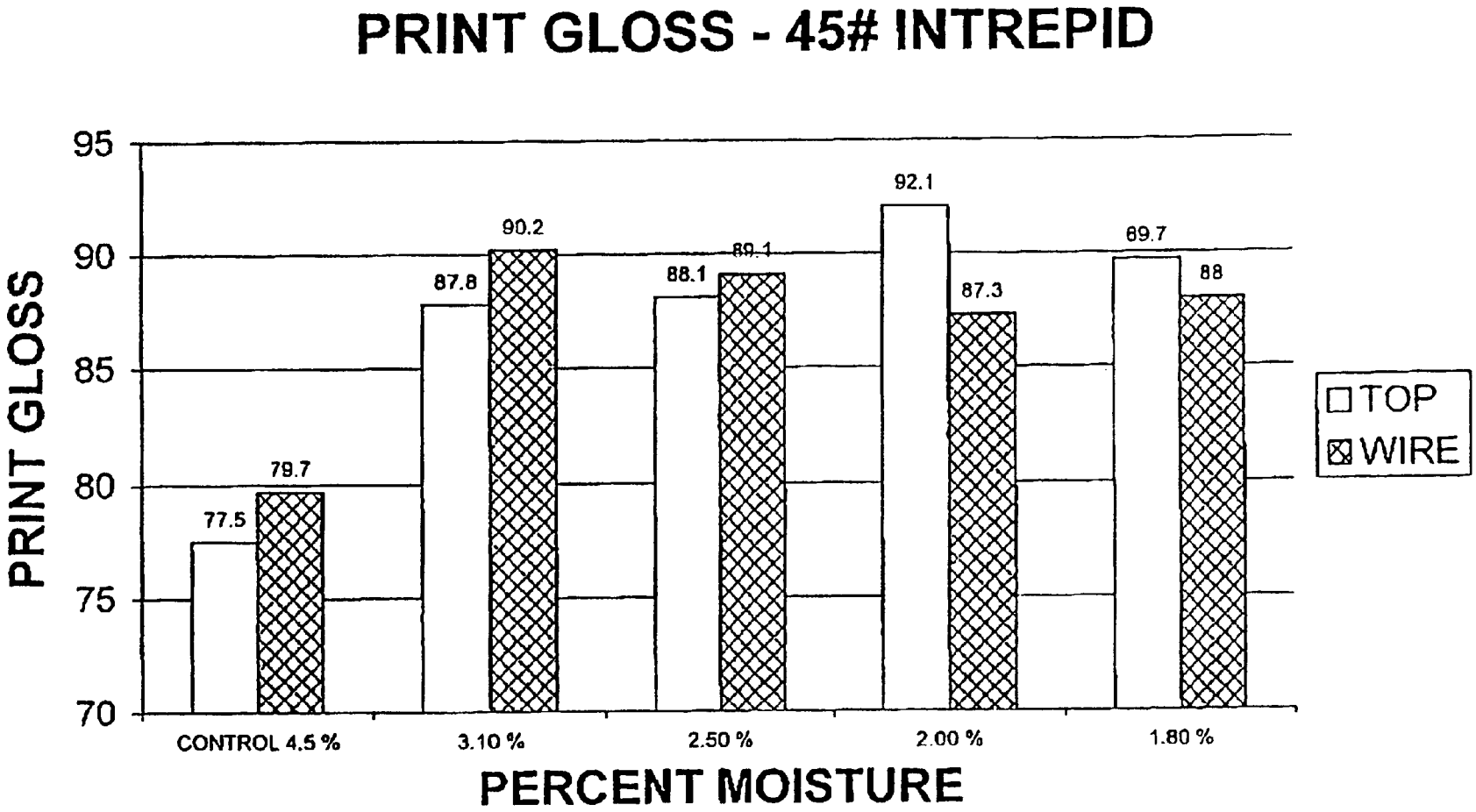
Figure 4:
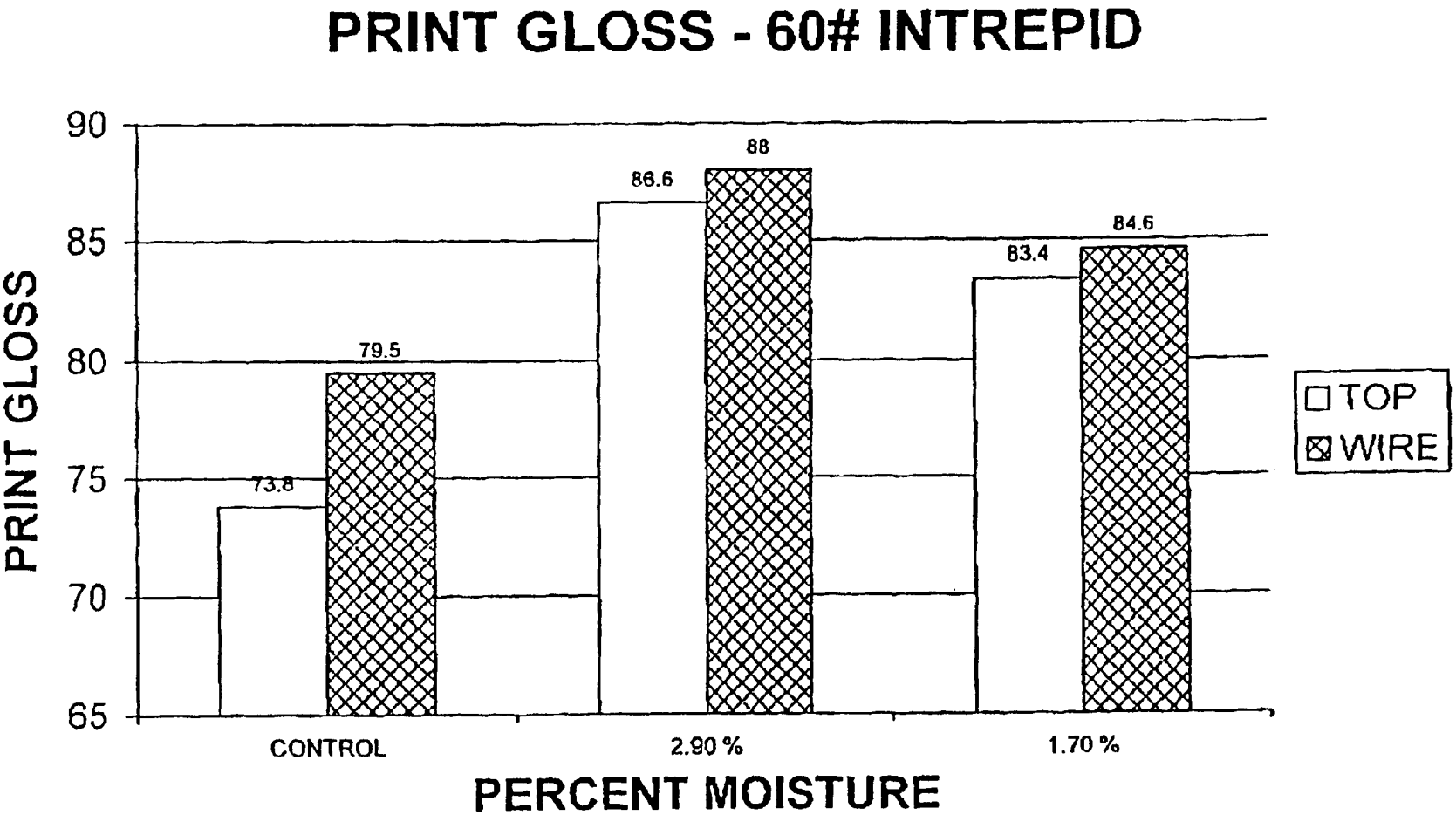
Figure 5:
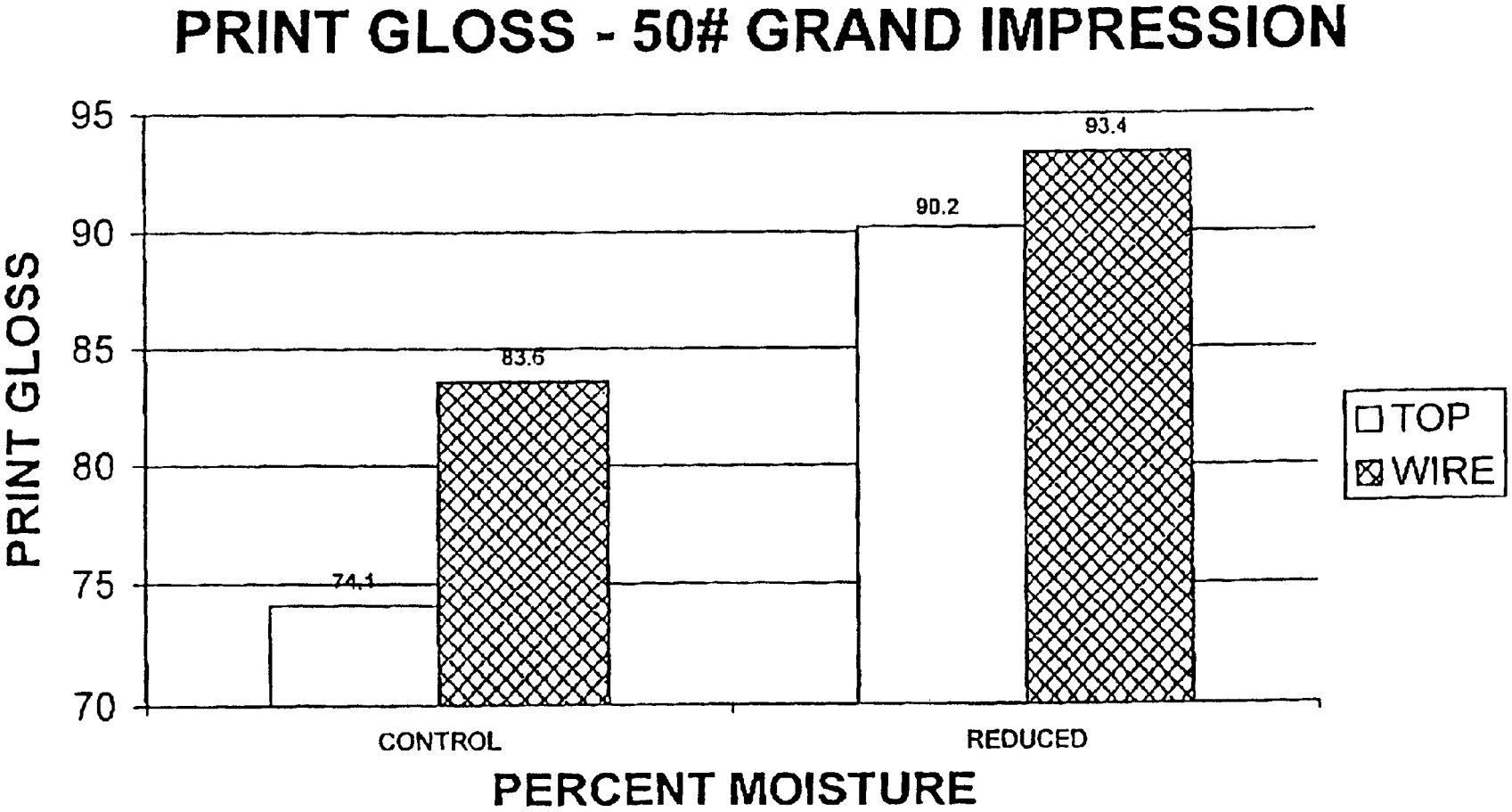
Figure 6:
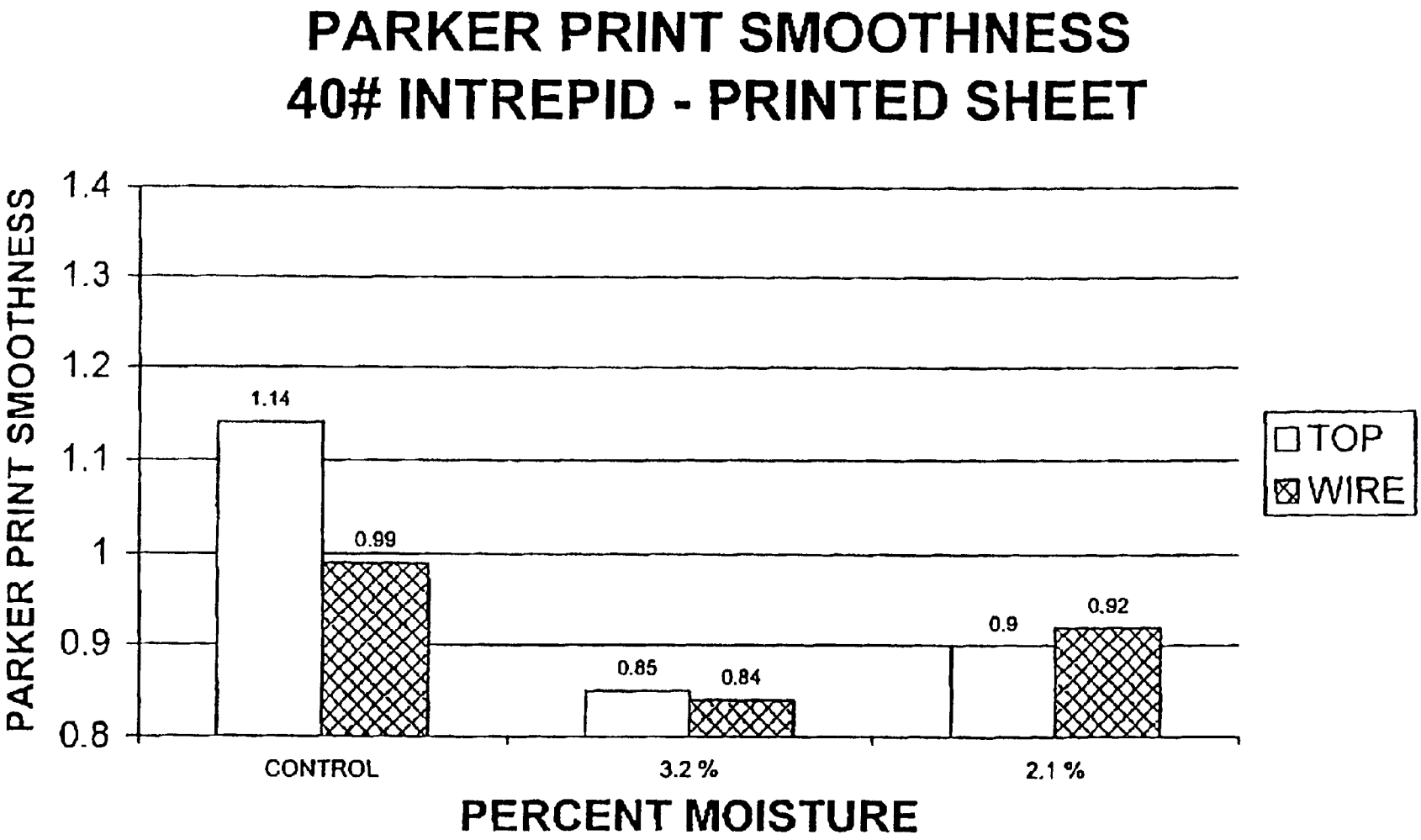
FIGS. 6 to 9 are diagrams showing the effect of the end moisture of the calendered sheet on print smoothness of printed sheet for some paper grades.
Figure 7:
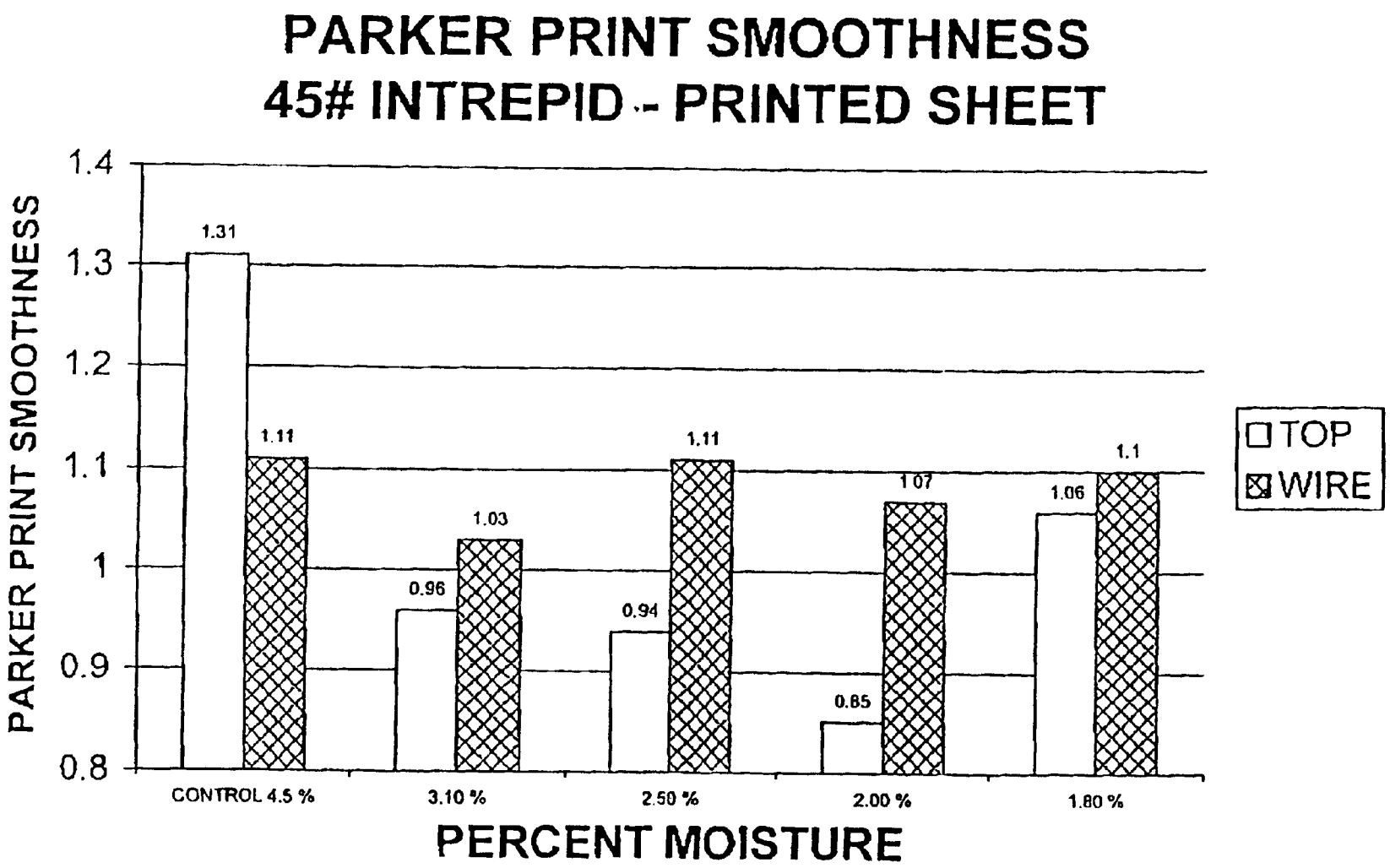
Figure 8:
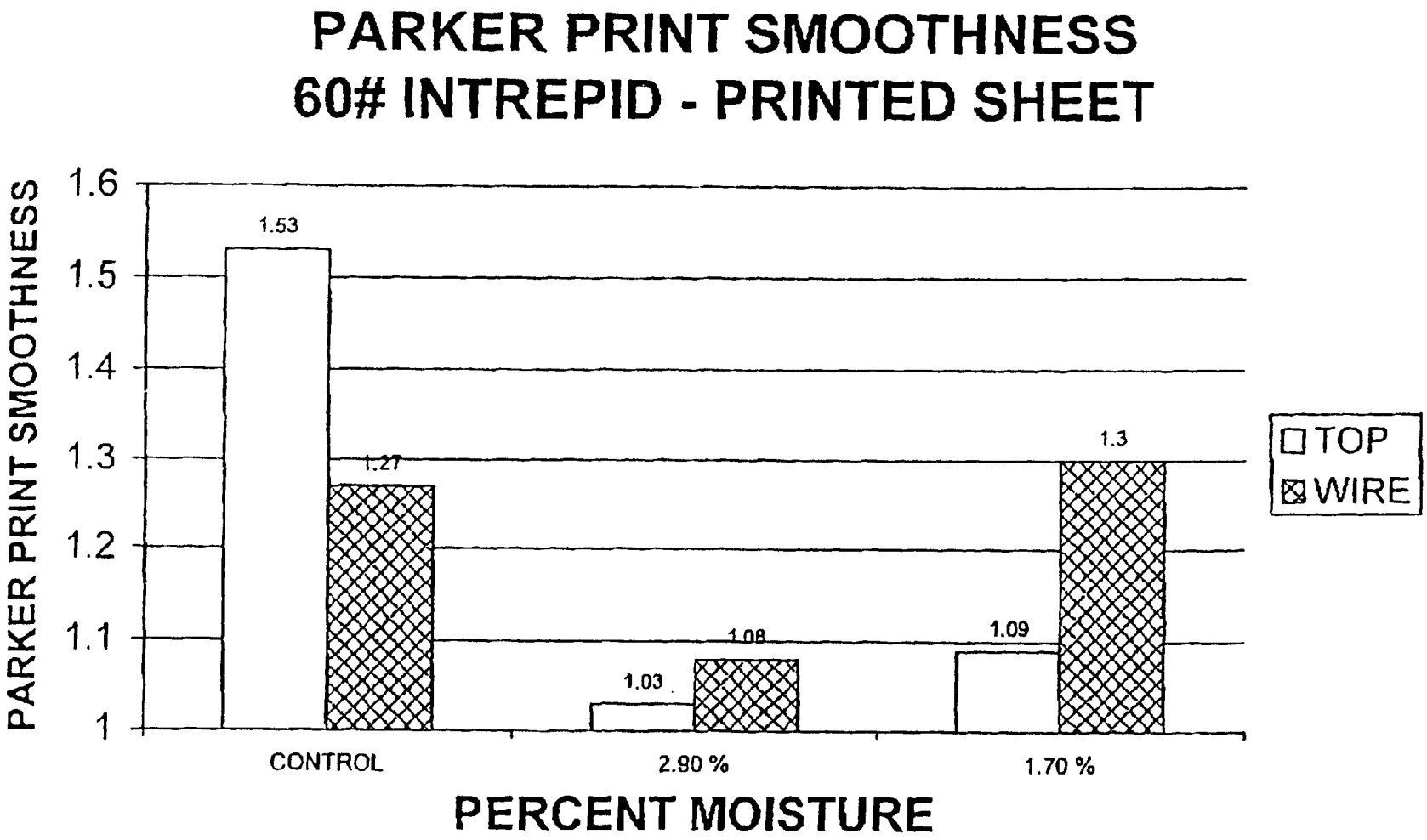
Figure 9:
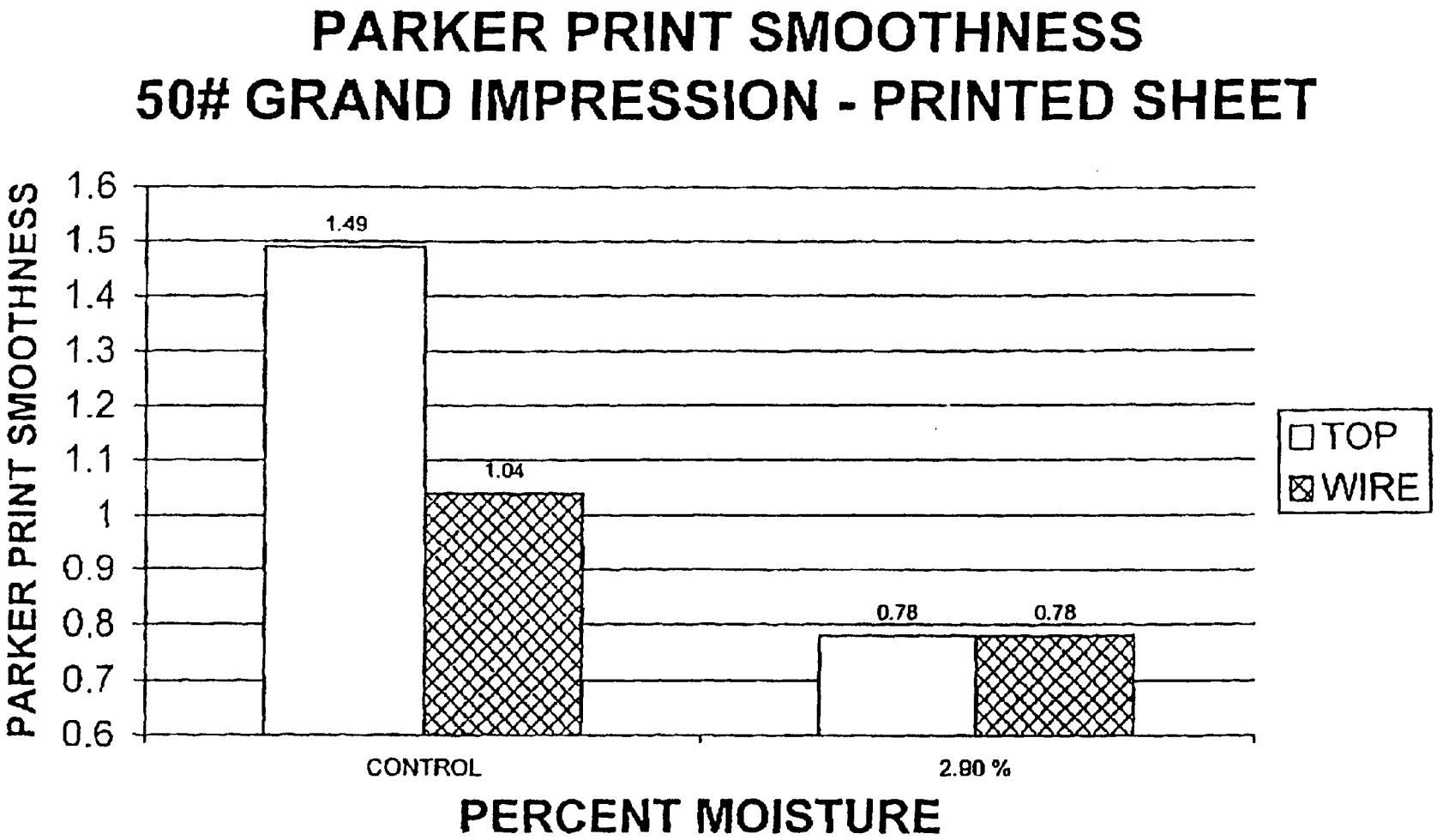

FIG. 1 shows an off-line calender, wherein the paper is handled as separate rolls manufactured in paper machine and finished in one or several coating stages. The rolls are unwound on an unwinder (not shown) and the paper sheet is lead to a multi-nip supercalender 1. The supercalender comprises a plurality of soft 18 and hard 19 rolls and guide rolls 17. The soft rolls 18 are coated with fiber material or synthetic material. The hard rolls 19 are usually made of steel. The rolls are arranged on a stack wherein each hard roll 18 is between soft rolls 19 and the paper sheet is lead through the nips between rolls 18, 19 by guide rolls 17 so that it passes through each nip. The calender also comprises load cylinders 20 at each end of the rolls 18, 19 for pressing the roll stack together. On the side of the calender 1 are top and bottom dryers 2, 3 for drying the calendered paper. The dryer system comprises paper guide rolls 5 and 8 for guiding the paper run 4 between the top and bottom dryers 2, 3. The dryers are positioned to face each other and any suitable contactless dryer type may be used, for example air float, air impingement or infra red dryer. When starting up, a threading tape 6 with tape drive 7 is provided for guiding the leading edge of the paper sheet through the gap between the dryers along the paper run 4 while starting up or threading a paper sheet through the process.

From the dryers 2, 3 the web is taken under the calender to a winder and the finished sheet is rewound on a roll 21. The sheet is first taken to a first spreader roll 9 which tensions the sheet in cross-machine direction in order to prevent crimping of the web. A second spreader roll 10 positioned upstream from the first spreader roll serves the same purpose. From the second spreader roll 10 the web is taken through fly rolls 12 to the winder (not shown). A scanner 13 for detecting properties of the sheet and a moisture detector are positioned on the web run between the fly rolls and the winder.

An alternative web run is provided directly from the calender 1 through the fly rolls 12 to the winder.

The above described embodiment is only one example of several apparatuses that may be used for implementation of the invention. For example, the winder and dryers may be positioned on the same side of the calender, more than one type of dryers may be used or the calender may be of some other type than a supercalender. In this specification the calender is defined to be an apparatus wherein a moving paper or paper board sheet is treated with heat and pressure. The dryers are preferably of a contactless type, but cylinder dryers may also be used if so desired. One important modification is a moisture controlling device that can be arranged before the calender. The moisturizing device can be a steam moisturizer, spray moisturizer or a film application device wherein the water is spread on a roll that runs in contact with the web. Each of these devices is in normal use in paper making industry and familiar to a person skilled in the art.

The invention can be implemented with several types of coating processes. The main types of coating methods are blade coating, wherein the coating mix is leveled of the web by a blade and roll coating wherein the coating mix is leveled on the web by an applicator roll. Blade doctoring and roll application can be combined and several types of coaters are included in these general groups. However, the film transfer or roll coater process has an advantage over the blade coaters. The film transfer coater or other types of roll coaters stresses the web much less than a blade coater whereby the web may contain less chemical fiber and more mechanical fiber. The strength of the web containing more mechanical fiber is lower than that of the web that contains only or high amounts of chemical fiber. The weaker web can be run in a film coater much more reliably. The use of mechanical fiber provides a bulkier sheet (higher caliper). However the disadvantage of film coater is higher application pressure and application time, whereby more water is penetrated into the web. This leads to a higher fiber rise during coating. Since the web is calendered after coating, this problem is avoided and the invention provides also means for preventing the finer rise during printing. For this reason it is possible to produce a sheet of paper that has the attributes of a sheet having greater basis weight.

The idea of the invention is to control the behavior of the fibers of the base sheet and the water content of the sheet so that a good smooth printing surface is obtained. One quality problem that may occur in printing of some high quality paper grades is fluting of the sheet in the printing press. Fluting means that the sheet corrugates in the machine direction in large scale or in several directions in small scale. In the large scale fluting corrugated waves are formed over large areas on the sheet and in small scale fluting the waves or deformations occur in such a small scale that no actual waves are formed but the surface of the sheet becomes irregular. The water absorbed causes the deformation of the sheet from the printing ink to the sheet. The invention is based on a surprising discovery that the moisture content of a calendered sheet has a significant effect on the properties of a paper sheet and the printing quality. Several test were performed in order to find out the limits of the invention and to achieve better understanding on the theoretical background of the invention. The test results and theoretical considerations are presented below.

Moisture content tests were performed on different paper grades on rolls which were run on printing press. One of the major conclusions was that the finished sheet moisture content going into the press had a significant effect on the degree of fluting tendency of the different sheets of paper. Papers with lower moisture content appeared to flute less than those with higher moisture content. Two sheets which stood out as having low fluting and low moisture were the S.D. Warren Somerset sheet and the Blandin Intrepid Low Glare sheet. The results from this first press evaluation lead to further investigation into the finished sheet moisture content and its affect on fluting. It was decided that the Blandin Pilot Coater could be utilized to drop the finished sheet moisture content on a number of different production finished Blandin sheets and that the different conditions would be evaluated on press at RIT (Rochester Institute of Technology). At this stage a number of ideas were discussed as to how the finished sheet moisture content could be lowered in production to decrease fluting tendency.

A second pressroom evaluation was conducted at RIT. In this evaluation a roll of Intrepid Gloss paper in which the finished sheet moisture content had been reduced from 4.6% to 1.7% was run on press. The standard sheet with the moisture content of 4.6% was also printed for comparison. When the Blandin sheet with the 1.7% moisture was printed, it was discovered that not only did the sheet have reduced fluting compared to the standard sheet with 4.6% moisture, but it also had significantly reduced fiber puff and higher ink gloss. On bases of these tests a third pressroom evaluation conducted to determine how low the moisture content would need to be to get the improved printed surface characteristics.

The third pressroom evaluation was also conducted at RIT. Blandin Intrepid paper with several different moisture content levels was run on press. All of the paper had been dried on the pilot coater in Blandin Research, some with Infrared Drying, some with Air Foil Drying, some with both. Results confirmed that the finished sheet moisture needed to be under 4.0%, preferably under about 3.0% to acquire all the desired printed sheet surface characteristics. Those characteristics included reduced fluting, reduced fiber puff, and higher ink gloss.

Following the third RIT pressroom evaluation, many different production trials were conducted in an effort to better understand the invention. Finished production paper was dried to below a 3.0% moisture either on the pilot coater or in production on the new 4A production coater. Paper was also dried to a lower moisture off the coater resulting in a lower moisture content off of the supercalenders. It was found that paper dried to a lower moisture content off the coater did not print as smoothly as paper dried to a higher moisture content off the coater. These trials show that a higher moisture content off the coater is required so that the sheet has the plasticity that it needs to smoothen its surface as it goes through the supercalender. It was concluded that to have a smooth print surface, you must start with a smooth unprinted surface, in other words the surface quality of the unprinted paper has an impact on the final printing result. Many different pressroom evaluations were conducted on trial rolls manufactured according to the invention to better understand the concept and the optimization limits and parameters. During these trials, several additional benefits of the invention were discovered-and capital requirements were also identified for the addition of dryers to the supercalenders on a production paper machine line. A drying system was designed to apply the invention in production scale and the drying system is currently operational.

Results of the trials and test show that the invention, when applied to the finished sheet and then printed, improves the sheet quality a number of ways:

- it reduces fiber puff and fiber rise improving printed sheet smoothness and ink gloss.
- it reduces ink absorption improving ink gloss and reducing ink consumption,
- it improves the sheets dimensional stability and reduces printed sheet fluting,
- it improves the sheet moisture profile and roll quality,
- it reduces blistering tendency, and
- it allows for a reduction in printed sheet ink mottle.

It is well known that running a lower moisture content in the finished sheet improves the sheet moisture profile. It is also well known that the lower the moisture content of the finished sheet going into the press, the less tendency the sheet will have to blister due to less moisture trying to escape through the sealed surface layer. What is not well understood is the affect of low moisture content on mechanical fiber, like groundwood fiber puff and fiber rise, improved ink gloss, reduced fluting, and binder migration mottle reduction. The theory behind each of these attributes is explained in following on bases of literature study, experimental analysis, and production trial and error in view of the present understanding of the invention.

Improvements seen in printed sheet smoothness and fluting tendency reduction of groundwood containing papers during offset printing as a result of the application of the invention are due to reduced water penetration into the sheet and reduced water expansion within the sheet. In web offset printing, water is applied to the surface of the sheet. Some of this water penetrates into the sheet and interacts with the fibers causing stress relaxation of the internal structural components, swelling of the fibers, and debonding of the fibers through dissolution or weakening of the fiber-fiber bonds. When coated paper is dried and calendered, the fibers within the sheet are flattened into a ribbon shape. When these fibers are re-wetted in the offset press, they swell. Chemical kraft fibers, though they swell when wetted, will maintain their flat ribbon shape and have minimal effect on the printed sheet smoothness. Groundwood fibers, when re-wetted during the offset printing process, will swell and transition from their ribbon shape to a tube shape. This transition is the result of water expansion (water changing from a liquid to gaseous state) during the drying phase of the offset printing process. Once the groundwood fiber has expanded, the lignin rich cell fiber wall stiffens and maintains this tube shape resulting in what we call fiber puff. If the groundwood fiber or part of the fiber is located near, or protruding from the surface of the sheet, the fiber appears to stick out from the surface of the sheet and this is called fiber rise. It is this fiber puff and fiber rise which causes a significant amount of sheet roughness and reduced ink gloss. It is clear that problems related to the fiber rise increase when the thickness of the coating layer decreases. Therefore the control of fiber rise on products comprising 1–5 g/m$^2$ coating per side, so called Ultra Light Weight Coated (ULWC) grades, is extremely important. The invention provides a good method for producing ULWC papers and boards also by using base web containing mechanical fiber by control of the fiber rise. The main principle how the invention controls the fiber rise is drying of the coated web into a very low moisture content whereby the fibers do not absorb water easily during the short moisturizing cycle of the printing process.

The problem with using higher moisture of the web when the web enters the calender is that it is extremely difficult to maintain good moisture profile of the web when it is not dried to a moisture of 3–4%. The moisture content that the invention preferably requires is 6–8% or preferably even more. These values are difficult to achieve simply by controlling the drying process of the paper machine. According to the invention the web is coated before calendering. The web can be normally dried as dry as desired, for example to a moisture content of 3.5–4%, and the water in the coating mix provides the water that raises the moisture content of the web to a desired level and the moisture content can be easily controlled by line measurement apparatus and by controlling the coating profile. Modern coating apparatus use normally dryers wherein the drying power can be controlled crosswise over the web, which provides an effective means for keeping the moisture of the web even and on a desired value.

Water which is bound within the sheet structure, and not necessarily within a fiber, can cause a considerable amount of sheet roughening also. When water and/or ink is applied to the surface of the sheet in the offset printing process, it seals the coating layer and hinders water (or gas) evaporation from the sheet during the drying process. The bound water will expand during the drying process resulting in a dissolution of the internal and external structure of the sheet. Small cracks in the coating layer can also be the result of this bound water expansion. These small cracks also contribute to print surface roughening, ink gloss reduction, and sheet surface dissolution. This internal and external sheet dissolution, because it disrupts the entire sheet structure, contributes to a loss of dimensional stability in the sheet which in turn results in printed sheet fluting.

The invention removes a significant portion of the internal and fiber bound water from the sheet structure prior to the printing press thus decreasing this internal and external sheet dissolution. Water removal from the finished sheet during the paper making process does not disrupt the internal or external sheet structure because the surface of the sheet has not been sealed and gaseous moisture vapor escapes freely. Because the moisture content of the sheet has decreased, the penetration rate of additional water into the sheet is reduced when the paper is printed on press. This phenomena is partly explained by the fact that most of the substances absorb water more easily if slightly wetted and have in a very dry state a hydrophobic character.

Tests conducted by the applicant at the Research laboratory at Blandin Paper show that reducing the finished sheet moisture content, according to the preferred embodiment of the present invention, to under 3.2% or in particular under 3.0% actually "sized" the surface of the sheet and reduced the rate of water penetration into the sheet. The word "sizing" in paper making industry means sealing the surface or increasing the strength of a paper or board usually by impregnating the surface with starch-based or other suitable substance. Water induced fiber expansion is decreased resulting in reduced groundwood fiber puff, fiber rise, and sheet dissolution. Because the fiber structure is maintained and water movement into and out of the sheet is reduced, fiber to fiber bonding is maintained and stress relaxation is significantly reduced. It is this stress relaxation and overall fiber distortion reduction which reduces the fluting tendency of the sheet. With less internal distortion, the sheet maintains more dimensional stability through the entire printing process resulting in the reduction in fluting.

Ink gloss enhancement results in part from the printed sheet smoothness improvement. The smoother surface allows for more even ink distribution on the sheet surface resulting in ink gloss improvement. Ink gloss enhancement is also the result of a reduced ink setting rate or absorbency of ink vehicle oil. Because the moisture content of the finished sheet has been reduced prior to the addition of ink, the ink absorbency rate has also been decreased. Fast ink setting rate causes a reduction in print gloss. High absorbency of the ink vehicle oil into the coating allows less time for the ink to flow to its ideal level on the paper surface. High absorbency also produces a rougher ink film resulting in lower print gloss. A lower ink absorbency rate allows for a reduced ink setting rate which results in a smoother ink film and thus improved ink gloss.

One of the additional benefits of the invention and one of its preferred embodiments is the affect on print binder migration mottle and process changes which allow for additional optimization of printed sheet smoothness. As mentioned earlier in this paper, trials were conducted in production to see if the finished sheet moisture could be reduced by lowering the sheet moisture off the coater and going to the supercalender. We found that as we lowered the sheet moisture going to supercalender, we roughened the finished sheet coming off the supercalender. As a result, even though the finished sheet moisture was lower, the white paper was so rough that the print surface was rougher also. What the invention allows for is that we can now run the coater moisture up higher and improve the white paper smoothness off the supercalender. In the past, this would have meant a higher moisture content off the supercalenders which would have created a number of problems in the pressroom. By reducing the total finished sheet moisture content after running a higher moisture into the supercalender, we are able to optimize and achieve additional improvement in printed sheet smoothness. It was also determined that by running a higher sheet moisture off the coater, coater drying rates were reduced, resulting in less coating binder migration on the coater. Less coating binder migration has been proven to significantly effect finished sheet print mottle on paper produced.

In an apparatus described in FIG. 1, wherein the paper is dried with a separate dryer after calendering, the typical limits for moisture content after coating and before entering the calender are about 3.0 to 8.0%, after calendering about 2.5 to 7.0% and after drying the final moisture content of the finished sheet is 0.0 to 4.0%, preferably 3,5% whereafter the paper is remoisturized to a moisture content between 0.5–4.0%. The typical favorable moisture contents used for Blandin gloss grade papers are 6.0% off the coater, 4.7% off the supercalender and 2.8% after drying and remoisturizing with a AM Technology process (AM=altered moisture) respectively.

The purpose of the remoisturizing is to finally level out possible variations in the moisture of the sheet and adjust the moisture of the sheet to a level best suitable for the printing method wherein the paper is to be used. However, the final moisture of the sheet may not exceed a value wherein the fibers absorb water or their hydrophobic properties obtained by drying after calendering will deteriorate. The remoisturizing of the dried sheet can be accomplished by applying water in a spray or film or preferably by using water vapor or humid air. The remoisturizing can be performed before winding or rolls may be set to moisturize in a humid atmosphere after winding.

FIGS. 2 to 5 show print glosses of different paper grades on different final moisture contents. The paper grades used in the comparison were 40# INTREPID, 45# INTREPID, 60# INTREPID and 50# GRAND IMPRESSION. The left columns show gloss of the top side of the sheet and the right columns show the glosses of the wire side of the sheet. It can be seen from all of the figures that decreasing the moisture content to 3.2% or less gave significantly better print gloss values compared to a control sample having a moisture content of, for example 4.5%. It also can be seen that if the moisture content is further decreased, the print gloss values did not increase or did decrease slightly. On bases of these test results it can be deducted that the optimum moisture content for different paper grades is about 3.0%.

The FIGS. 6 to 9 show the effect of altered moisture content to Parker print smoothness. The same paper grades as mentioned above were used in the evaluation. In smoothness scale smaller values describe better smoothness, i.e. smaller values indicate smoother surface. Also here it can be seen that decreased moisture of the sheet gives significantly better smoothness and further decreasing the moisture content does not usually give better smoothness. One further feature is that the difference in smoothness of top side and wire side of the sheet usually changes when moisture is decreased in comparison to the control samples.

Figure 10:
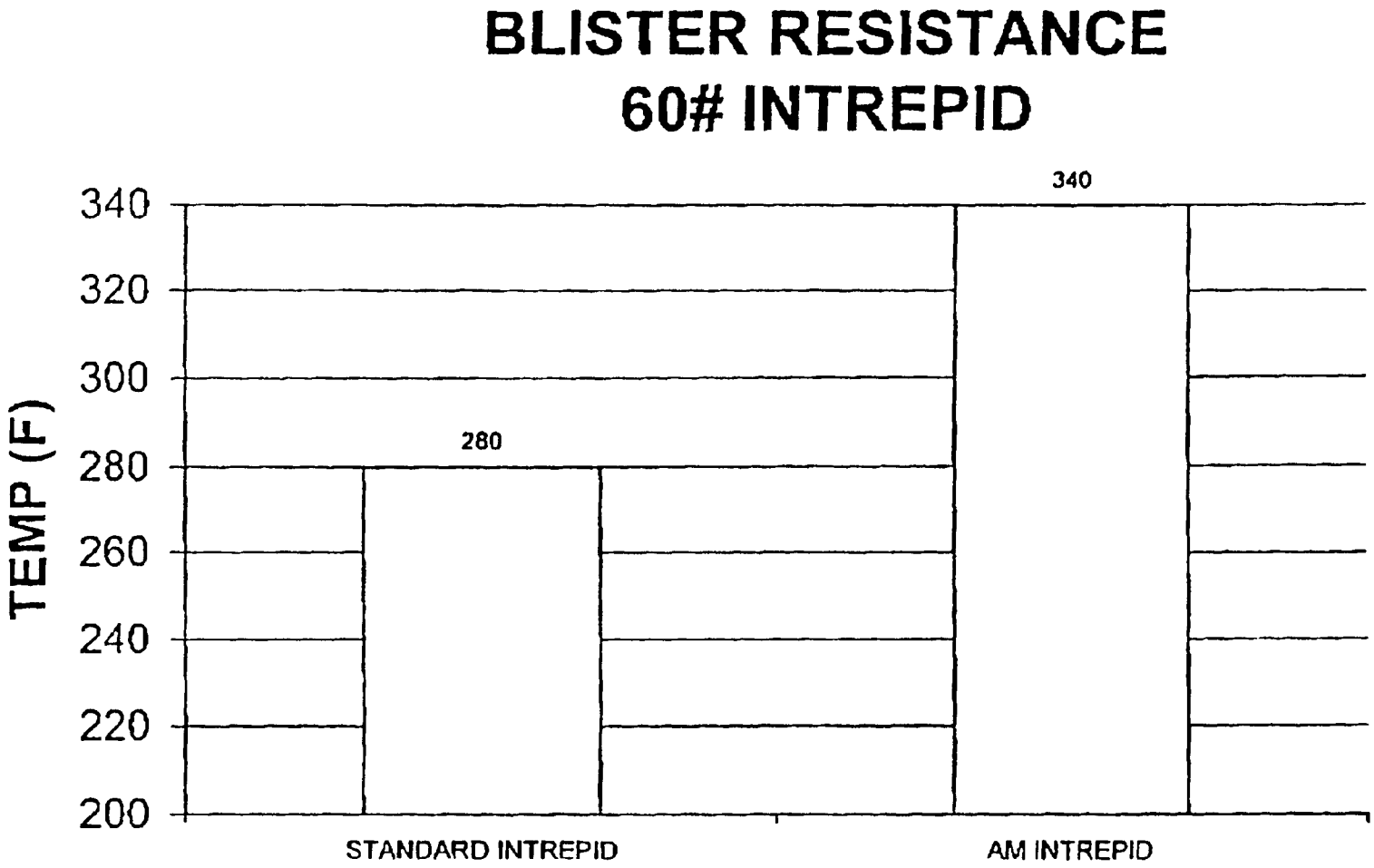
FIG. 10 is a diagram showing the blister resistance of a paper manufactured according to the invention in relation to a reference grade.
Figure 11:
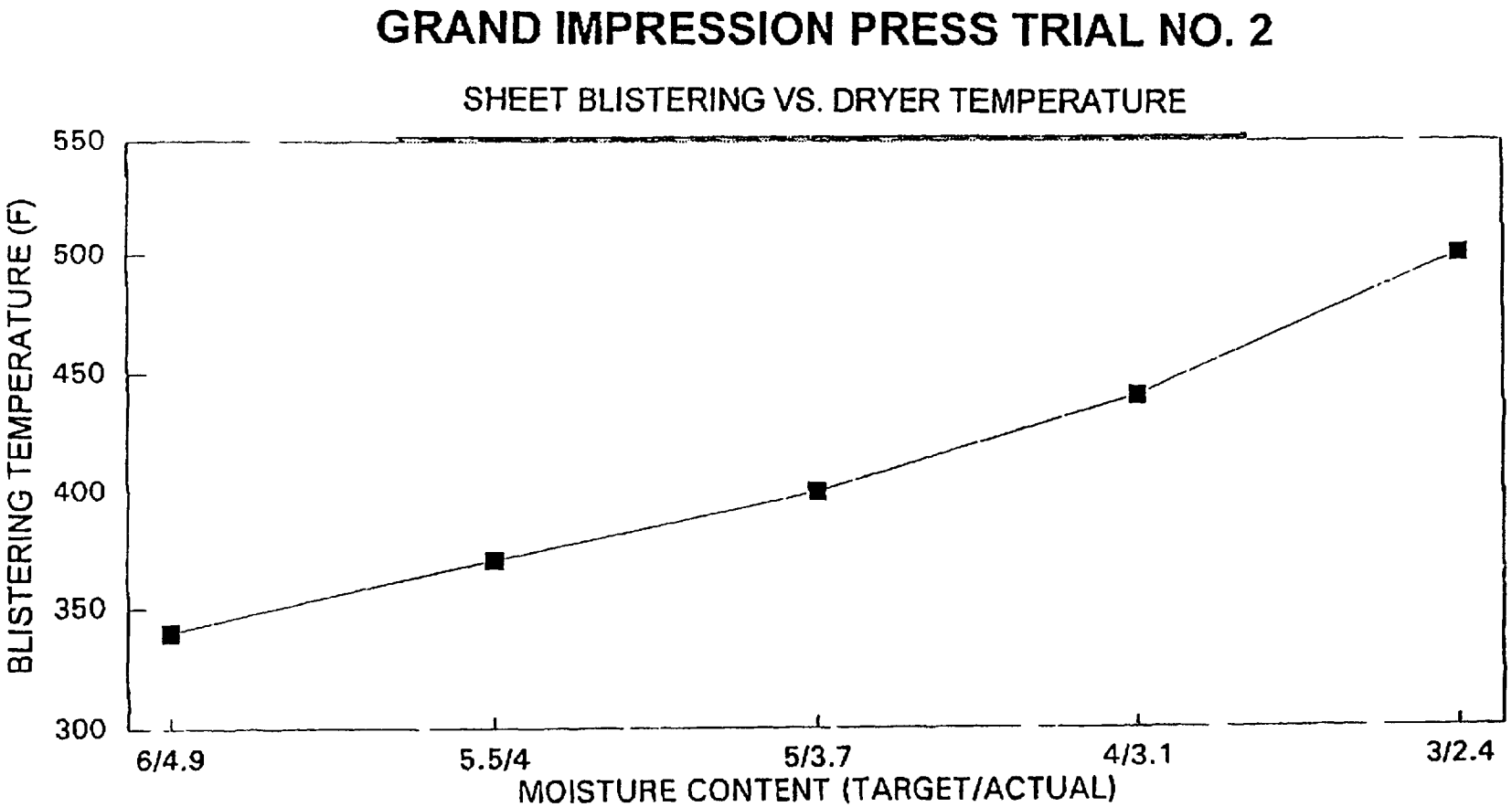
FIG. 11 shows the effect of the moisture content of the sheet on the blistering temperature.

FIGS. 10 and 11 show results blistering tests on 60#INTREPID and GRAND IMPRESSION GRADES. Blistering is a phenomenon wherein water evaporating within a paper or cardboard sheet disintegrates the surface of the sheet. As can be seen from FIG. 10, the ALTERED MOISTURE INTREPID (AM INTERPID) produced according to the invention has a considerably higher blistering temperature and resistance than standard INTREPID. FIG. 11 shows clearly that when the moisture content is decreased, the blistering temperature increases almost linearly. Note that the diagram shows both target and actual moisture contents and the curve between 3.1 and 2.4% actual moisture is slightly steeper. However, more measurement points would be needed to surely show more rapid increase in blistering temperature when moisture content is lowered below 3.1%, but the diagram gives at least an indication of probable results.

According to the invention, a paper or board sheet is handled in a calender which is preferably a supercalender or alternatively an improved calender designed on basis of the supercalender operating principles. Suitable calender types have been mentioned above. After calendering the sheet is dried in a separate dryer before winding to a moisture content that is 4% at highest and preferably about 3.0%. It might be possible to adjust the final moisture content in the calender to above mentioned value, but then the calendering result may not be as good as when separate drying step is used. Also the temperature control of the heated rolls of the calender may be more difficult if very dry paper is produced without drying after the sheet is handled in the calender. The invention may be implemented on other calender types also, but the benefits may not be as great as when implemented on supercalendered papers since the smoothness of paper grades thus produced is not as good as that of grades made by supercalendering or similar high-gloss calendering methods. The invention is preferably implemented on paper grades based on groundwood base sheet that is coated with at least one coating layer. However, it is possible to implement the invention also to grades based on chemical kraft and for uncoated grades and also for paper board. The supercalender is advantageously arranged on-line with a coater, but the paper can be brought to the calender from an unwinder or directly from a paper or board machine.

The drying of the paper or board sheet and remoisturizing can also be performed in a separate step by unwinding the calendered and wound sheet and drying and/or remoisturizing the sheet, whereafter the sheet can be directly printed or rewound on a roll. This method makes it possible to handle the sheet directly before printing in a desired manner.

Thus, while there have been shown and described and pointed out fundamental novel features of the invention as applied to a preferred embodiment thereof, it will be understood that various omissions and substitutions and changes in the form and details of the invention may be made by those skilled in the art without departing from the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

What is claimed is:

1. A method for producing calendered paper or paperboard, comprising steps of manufacturing a web base sheet of paper or board, coating the web base sheet with at least one coating layer so that water is absorbed in the web, bringing the base sheet containing water to a calendar, leading the web base sheet through at least one nip formed by two rolls of the calender and imposing simultaneously heat and pressure on the web base sheet in the nip in order to treat the surface of the web, whereby also water is removed from the sheet, drying to remove water from the web base sheet before printing to such an extent that the moisture content of the sheet is adjusted to a value of 0.0 to 4.0%, remoisturizing the sheet after calendering and drying to a moisture content of 0.0 to 4.0%, leading the treated sheet to a winder, and winding the sheet on a roll.

2. The method according to claim 1, wherein the web base sheet is dried with at least one dryer after calendering and before winding.

3. The method according to claim 2, wherein the calender is a supercalender.

4. The method according to claim 2, wherein the calender is a soft-nip, opti-load or a Janus Concept Calender.

5. The method according to claim 1, herein the coating layer of the web base sheet has a final coat weight of 1–5 $g/m^2$.

6. The method according to claim 1 wherein the web base sheet is coated with a roll coater, or a film transfer coater.

7. The method according to claim 1, wherein the moisture content of the web base sheet before calendering is 3.0 to 8.0%.

8. The method according to claim 2, wherein the moisture content of the web base sheet after calendering and before drying is adjusted to a value of between 2.5 to 7.0%.

9. The method according to claim 1 wherein the sheet is coated with a blade coater.

10. The method according to claim 1, wherein the sheet is remoisturized before winding, with water, water spray, steam or humid air.

11. The method according to claim 1, wherein the sheet is remoisturized before winding with steam or humid air.

12. The method according to claim 1, wherein the drying and remoisturizing of the web base sheet is effected after unwinding the web base sheet from the roll and prior to printing.

13. The method according to claim 1, wherein the remoisturizing of the web base sheet is effected after unwinding the web base sheet from the roll and prior to printing.

14. The method according to claim 11, wherein prior to winding the moisture content of the web base sheet is adjusted to a value of 0.0 to 3.0%.

15. A method for producing calendered paper or paperboard which comprises manufacturing a web base sheet of paper or board, coating the web base sheet with at least one coating layer whereby water is absorbed in the web, calendering the web base sheet by conveying it through a calender containing at least one nip formed by opposing rolls, wherein heat and pressure is applied to the web base sheet at the nip and some water is removed therefrom, drying the web base sheet to a moisture content of 0.0 to 4%, and remoisturizing the web base sheet to a moisture content of 0.0 to 4%.

16. The method of claim 15 wherein after coating but before entering the calender, the water content is about 3 to 8%.

17. The method of claim 16 wherein after calendering, the water content is about 2.5 to 7%.

18. The method of claim 17 wherein after drying, the water content is about 0.0 to 4.0%.

19. The method of claim 18 wherein after remoisturizing, the moisture content is between 0.5 to 4.0%.

20. A method for producing calendered paper or paper board which comprises manufacturing a web base sheet of paper or board, coating the web base sheet with at least one coating layer whereby water is absorbed in the web, calendering the web base sheet by conveying it through a calender containing at least one nip formed by opposing rolls, wherein heat and pressure is applied to the web base sheet at the nip and some water is removed therefrom, winding the web base sheet as a roll, unwinding the web base sheet, drying the web base sheet, and remoisturizing the sheet prior to printing.

21. The method of claim 20 wherein the web base sheet is remoisturized to a moisture content of 4.0% or less.

22. A method for producing calendered paper or paper board which comprises manufacturing a web base sheet of paper or board, coating the web base sheet with at least one coating layer whereby water is absorbed in the web, calendering the web base sheet by conveying it through a calender containing at least one nip formed by opposing rolls, wherein heat and pressure is applied to the web base sheet at the nip and some water is removed therefrom, remoisturizing the sheet prior to printing.

* * * * *